United States Patent [19]

Bouvrande

[11] 4,439,646

[45] Mar. 27, 1984

[54] KEYBOARD SWITCH ASSEMBLY

[75] Inventor: André M. Bouvrande, Boissy St Antoine, France

[73] Assignee: Societe de Telecommunications Electronique Aeronautique et Maritime T.E.A.M., France

[21] Appl. No.: 370,258

[22] Filed: Apr. 20, 1982

[30] Foreign Application Priority Data

Apr. 22, 1981 [FR] France ..... 81 08024

[51] Int. Cl.[3] ..... H01H 13/70

[52] U.S. Cl. ..... 200/5 A; 200/159 B; 200/275; 200/340

[58] Field of Search ..... 200/5 R, 5 A, 159 B, 200/314, 317, 340, 275

[56] References Cited

U.S. PATENT DOCUMENTS

| | | | |
|---|---|---|---|
| 3,749,859 | 7/1973 | Webb et al. | 200/5 A X |
| 3,780,237 | 12/1973 | Seeger, Jr. et al. | 200/5 A |
| 3,941,964 | 3/1976 | Yoder | 200/5 A X |
| 4,029,916 | 6/1977 | Chu | 200/5 A |
| 4,302,647 | 11/1981 | Kandler et al. | 200/5 A X |
| 4,314,117 | 2/1982 | Ditzig | 200/5 A |
| 4,365,120 | 12/1982 | Pounds | 200/5 A |

*Primary Examiner*—J. R. Scott

*Attorney, Agent, or Firm*—Steinberg & Raskin

[57] ABSTRACT

The present invention relates to a device forming a panel for a keyboard and/or push-buttons mounted for instance on the instrument board of an airplane and which is removably mounted on a wall and front face plate, the plate assembly being constituted by two sub-assemblies, for example a lower and an upper assembly removably assembled together.

6 Claims, 6 Drawing Figures

KEYBOARD SWITCH ASSEMBLY

BACKGROUND OF THE INVENTION

The present invention relates to a device forming a panel for a keyboard and/or individual keys or pushbuttons.

There are already known in the prior art such devices which can be mounted and used on a wall of a dashboard or an instrument panel of a vehicle such as for example an airplane, or on any electronic apparatus.

For example, such panels may be connected to an on-board microcomputer through the medium of an interface logic for the purpose of processing accurate information.

The panels of the prior art comprise a front face plate through which keys or pushbuttons project which are depressable for establishing an electric contact between contacts on a printed circuit board mounted in the panel, which pushbuttons may be luminous.

However, such panels suffer from the drawback that they are not directly dismountable from the wall of the panel or board, or, if removable, do not provide ready access to the incorporated electric components such as the electric bulbs or the aforesaid push-buttons.

Thus, when a bulb is defective or a push-button deteriorates, the user usually cannot directly effect the repair of the member concerned and must either send the whole panel to the manufacturers for repairs or replace the complete keyboard including the defective push-button or bulb.

On the other hand, should the user attempt to effect the repairs himself by disassembling the various plates or layers of the panel in order to reach the defective member, he would risk exposing simultaneously all the other members and in particular separating and losing each key and its associated parts.

SUMMARY OF THE INVENTION

The purpose of the present invention is to remedy the above drawbacks by providing a device forming a panel directly dismountable from the wall of the board or of the apparatus and from which the user may himself effect any repair without risking losing any member whatsoever.

To this end, the invention relates to a device forming a panel for a keyboard and/or individual depressable keys, removably mounted on a wall of an electric control board or apparatus of, for example, a vehicle and comprising a front face plate through which the depressable keys, which may be luminous project, characterized in that the device is closed by the wall of the apparatus and comprises at least one push-button removably mounted in the front face plate and dismountable through the rear, and an assembly of plates including a printed circuit board having contacts thereon electrically connected by the push-button with an associated contact member, the assembly being removably mounted under the front face plate.

According to a characterizing feature of the invention, the assembly of plates of the device comprises two sub-assemblies, that is, a lower assembly and an upper assembly removably assembled to one another, the printed circuit board being provided in the lower sub-assembly and supporting at least one bulb accessible from the rear face of the lower sub-assembly when the device is broken away from the wall of the apparatus.

It is therefore understood that by simply dismounting the device of the invention from the wall of the apparatus, a direct access is obtained to any defective bulb and that the dismounting of the assembly of plates of the front face plate provides access to each depressable key.

According to another characterizing feature of the invention, each depressable key comprises a plunger and a compression spring unlosably connected or captured to the depressable key body.

Consequently, not only is it possible to easily reach the push-buttons but, moreover, any risk of separation of the parts associated with each depressable key is eliminated.

According to another characterizing feature of the invention, the contact member is a blister-type contact including a resiliently deformable concave portion resting upon the printed circuit plate and removably maintained between the lower and upper sub-assemblies.

Thus, by simply dissociating the lower and upper sub-assemblies, any contact blister may be easily reached.

DETAILED DESCRIPTION OF THE DRAWINGS

The invention will be better understood and other purposes, characterizing features, details and advantages of the latter will appear more clearly from the following explanatory description made with reference to the appended diagrammatic drawings given solely by way of example and illustrating two forms of embodiment of the invention and wherein.

DESCRIPTION OF THE PREFERRED EMBODIMENTS

Figure 1:
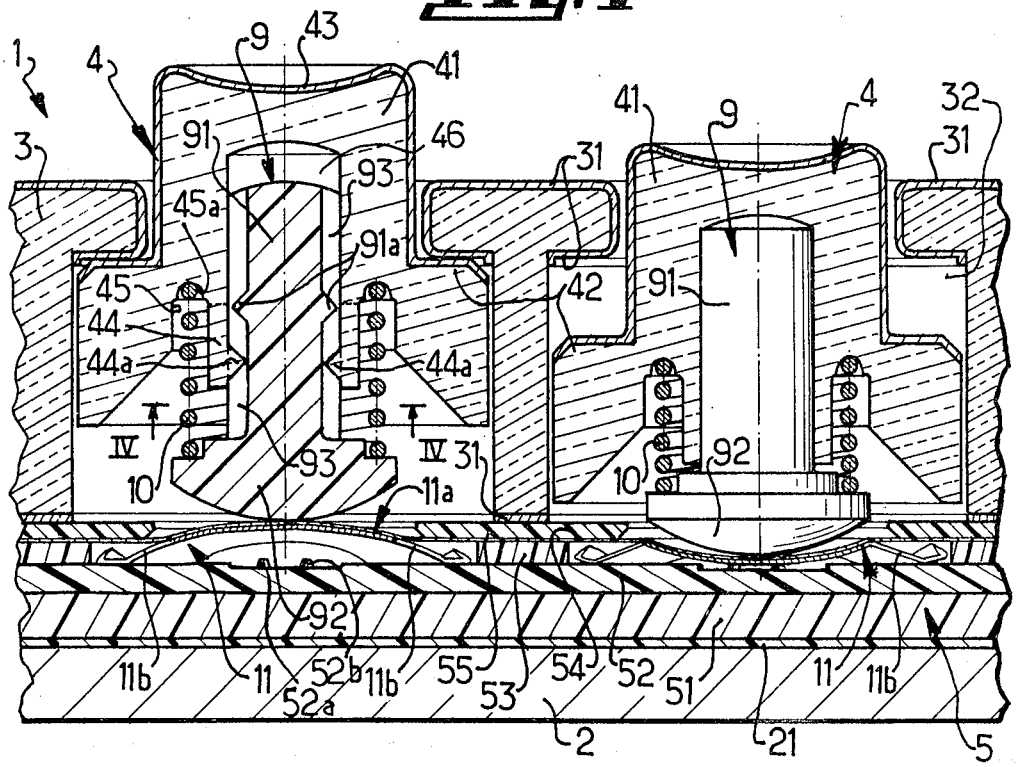
FIG. 1 is a cross sectional view of the panel device and represents two impulse push-buttons, one of which is in the rest position and the other in the working position.

Referring to FIG. 1, the panel device 1 according to the invention is removably mounted by means of screws A (see FIG. 2) on a wall 2 of a dashboard or instrument panel of a vehicle such as for example an airplane, or of an electric or electronic control apparatus.

The panel device 1 comprises a front face plate 3 through which projects at least one depressable key or push-button 4 accommodated in the front face plate, and an assembly of plates 5 removably mounted by means of screws B (see FIG. 2) under the front face plate 3. The assembly 5 comprises a thickness plate 51 in contact on the wall 2 through the medium of an insulating layer 21 adhesively secured to the wall, a printed circuit board 52 adhesively secured to the plate 51, an insulating board 53 adhesively secured to the printed circuit plate 52, a resilient membrane 54 in contact on the insulating plate and a membrane carrying plate 55 to which is adhesively attached the resilient membrane.

The assembly of plates 5 is constituted by two sub-assemblies of plates, that is, a lower sub-assembly and an upper sub-assembly, the lower sub-assembly comprising the plates 51, 52 and 53 whereas the upper sub-assembly comprises the resilient membrane 54 and the plate 55.

Figure 2:
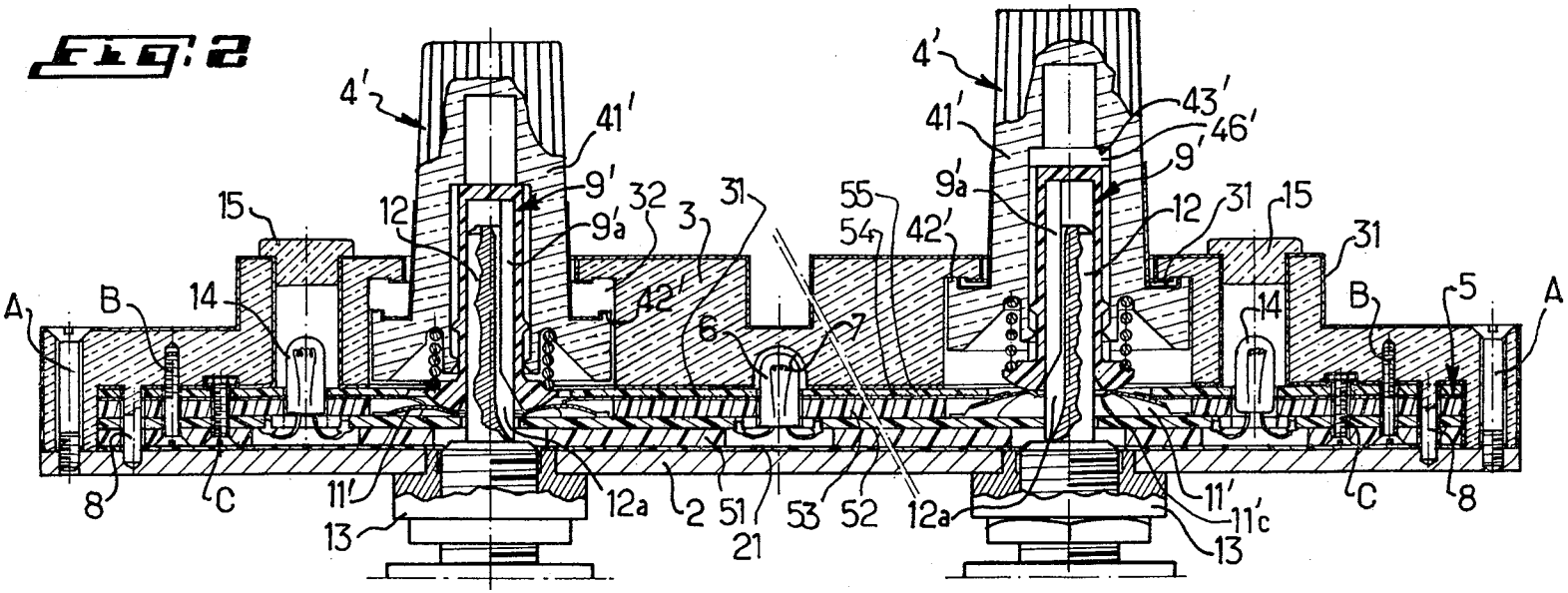
FIG. 2 is a cross sectional view of the device of the invention and represents two rotary impulse push-buttons, one of which is in the rest position whereas the other is in the working position.

The lower and upper sub-assemblies are removably fixed to one another by means of screws C (see FIG. 2).

The front face plate 3 may be of any translucent material and is covered on its outer face with an opaque material 31, for example a paintlayer, whereas its inner face in contact on the plate 55 also comprises an opaque material which also may be a layer of paint.

On the printed circuit board 52 is mounted and welded at least one bulb 6 (see FIG. 2) serving for example to illuminate each depressable key of the panel.

A socket 7 (see FIG. 2) provided in the front face plate caps the bulb head whereas the bulb body passes through an orifice provided in the lower and upper sub-assemblies (FIG. 2). The bulb contact terminals are welded to the lower face of the printed circuit board and project into an orifice provided in the thickness plate 51.

According to the invention, access to the bulb 6, in case the latter should be defective, is gained very simply. The screws A are first unscrewed, thus releasing the panel device 1 from the wall 2, the assembly of plates 5 remaining attached to the front face plate by the screws B. Easy access to the contact terminals of the bulb can therefore be obtained through the aforesaid orifice of the thickness plate 51 to allow unwelding the same, removing the defective bulb and replacing it by a new one. Bulb replacement can therefore be effected directly by the user.

Figure 3:
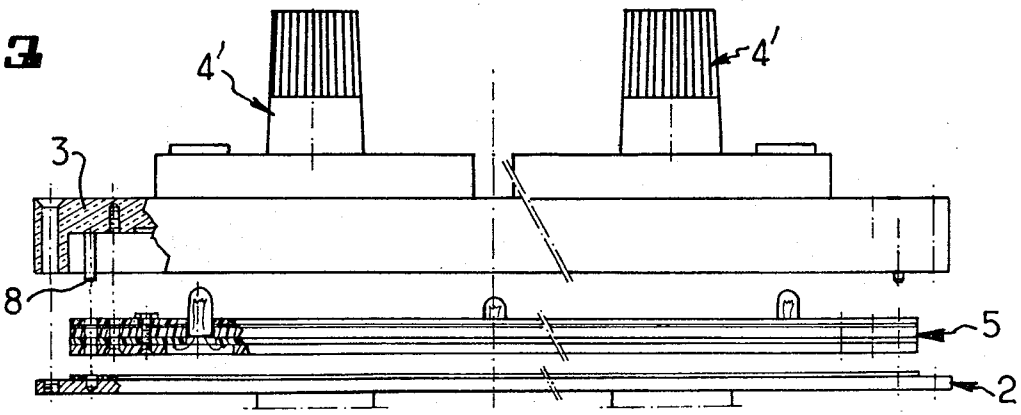
FIG. 3 is a diagrammatic, partially sectional view of the panel device according to the invention showing the assembling of the assemblies of plates of the panel.

The panel device is thereafter repositioned on the wall 2 without any difficulty owing to the centering pins 8 (see FIGS. 2 and 3) projecting from and secured to the front face plate 3.

The depressable key 4 such as illustrated in FIG. 1 is a push-button of the impulse type. It comprises a body 41 movable in a cavity 32 of the front face plate. This cavity opens at the upper portion of the front face plate through an orifice through which the upper portion of the push-button body passes, and opens at the lower portion of the front face plate onto the assembly of plates 5. The push-button is displaceable in the cavity 32 of the front face plate and its displacement is limited at the upper portion of the front face plate by a shoulder 42 integral with the push-button body and abutting against a flange portion 31 of the front face plate.

The upper portion of the push-button body and the corresponding orifice of the front face plate may be identical in cross section, for example square or cylindrical. The lower portion of the push-button body and the cavity of the front face plate receiving the lower portion may also be identical in cross section, that is cylindrical or square.

The external periphery of the upper portion of the push-button body and the flange portion 42 may be covered with an opaque material 43 such as paint. In the form of embodiment illustrated, the push-button top is convex in shape and may carry any appropriate engraved symbols or signs, which engraving may be translucent. Thus, the light emitted by the bulb 6 passes through the translucent plate 3, is reflected by a wall inclined at 45° in the shape of a truncated cone provided in the lower portion of the push-button body and opening towards the assembly of plates 5. The light path is therefore directed towards the engravings so as to illuminate them. According to another modified form of embodiment, the push-button body may be made from a translucent material with an opaque engraving.

In the push-button body 41, within its axial portion, is provided a longitudinal chamber 46 forming a closed cylinder in the upper portion of the body 41 and opening at the lower portion of the body by means of a cylindrical wall projecting towards the assembly of plates 5.

Figure 4:
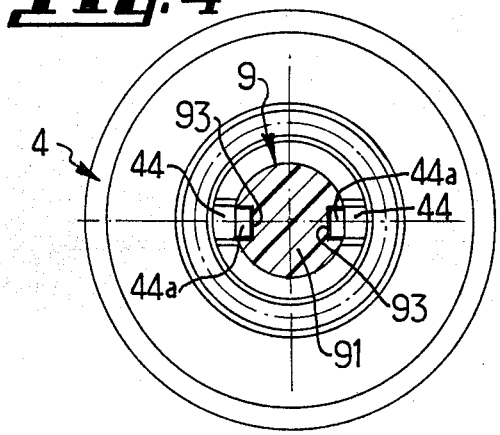
FIG. 4 is a sectional view upon section line IV—IV of the impulse push-button.

As illustrated in FIG. 1 and in FIG. 4, the cylindrical wall of the chamber is provided with two resilient longitudinal tongues 44 cut in the wall in diametrically opposite relationship to one another. Each tongue is provided on its inner face with a protuberance **44*a* projecting into the chamber. The tongue-and-protuberance assembly therefore is jointly movable with the body 41** of the push-button.

Within the chamber 46 is slidably movable a plunger 9 comprising a solid, for example, cylindrical, elongated portion 91, the lower end of which flares to form a head 92 with a bulging end.

Two slots 93 are provided along the elongated portion 91 of the plunger in diametrically opposite relationship to one another (see FIG. 4). Within each slot and within the medial portion of the elongated portion of the plunger is located a protuberance **91*a*** integral with the plunger, the other protuberance of this plunger being diametrically opposite thereto.

The protuberances **91*a* are positioned above the protuberances 44*a* which are located in each of the slots 93. Thus, the protuberances 44*a* and 91*a* allow the plunger stroke within the chamber to be limited and the separation of the plunger from the push-button body 41** to be prevented.

The function of the slot 93 is to allow the plunger 9 to be fitted into the chamber of the push-button body, the tongues 44 being moved aside by the action of the protuberances **91*a* upon the protuberances 44*a***.

The flared portion of the plunger 9 comprises a circular flat surface behind the plunger head bulge. On this flared surface bears the lower end of a cylindrical precompression spring 10. The upper end of the cylindrical spring is located in a longitudinal annular cavity 45 provided in the push-button body. The longitudinal portion of this cavity is concentric with both the longitudinal tongues 44 and the plunger 9. The outer surface of the cylindrical wall of the plunger chamber in which the tongues 44 are cut corresponds to the inner diameter of the cavity. Thus, the inner cylindrical wall of the cavity is defined by the outer surface of the cylindrical wall of the chamber and is equal in length to the tongue. The outer cylindrical wall of the cavity 45 is smaller in length than the tongue 44 and is extended by the aforesaid truncated conical wall. The outer cylindrical wall of the cavity and the truncated conical wall form together a cylindroconical whole surrounding the plunger 9. The truncated conical portion thus provided in the push-button body flares beyond the tongues 44.

The spring 10 is thus mounted between the plunger head and the push-button body and surrounds the plunger.

According to the invention, the push-button, the plunger and the spring together form an unlosable, i.e., a captured or integrated assembly. Indeed, when this assembly is caught in itself, the spring exerts on the plunger a push tending to move it in a direction opposite to the push-button body. This movement is stopped by the protuberances 44*a* and 91*a*, thus preventing the plunger from escaping from the push-button body.

The bulged portion of the plunger head 92 bears upon a contact member or contact blister 11 through the medium of a resiliently deformable membrane 54. This contact blister allows an electric contact to be established on the printed circuit board when the push-button 4 is depressed.

Figure 5:
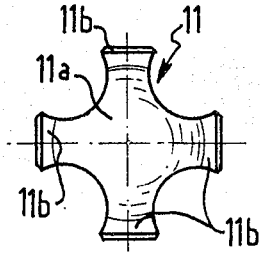
FIG. 5 is a top view of a contact blister.

As shown in FIGS. 1 and 5, the contact blister 11 comprises a resiliently deformable concave portion 11*a*.

Along the periphery of the concave portion are provided several support legs 11*b*. In the example illustrated, the legs are four in number. The contact blister rests by its legs on the printed circuit plate 52 and is accommodated in an open orifice provided in the insulating plate 53. The concave portion 11*a* of the contact blister projects through an orifice provided in the membrane-carrying plate 55. The contact blister 11 is maintained by the resiliently deformable membrane 54 which partially takes the shape of the concave surface of the blister contact.

When a pressure is exerted on the push-button 4, the displacement of the body 41 causes the plunger 9 to slide within the chamber of the body, the end of the elongated portion 91 of the plunger abuts against the blind portion of the chamber. As the pressure continues to be exerted, the assembly constituted by the body 41 and the plunger 9 moves towards the printed circuit board 52, the distance between the protuberances 44*a* and 91*a* being maintained constant by the spring 10. The plunger 9 jointly deforms the resilient membrane 54 and the concave surface of the blister member. The contact blister takes the shape shown in the right portion of FIG. 1 and establishes an electric contact between contacts 52*a* and 52*b* on the printed circuit board. In the depressed position, the lower edge of the lower portion of the push-button body does not bear upon the membrane-carrying plate 55 and the lower edge of the tongue 44 does not bear upon the internal face behind the bulged portion of the head. When the pressure on the push-button 4 is released, the resilient membrane 54 and the blister contact tend to reassume their normal shape in the rest position and exert an upward force on the plunger 9 which, under the combined action of the spring 10, compels the push-button body to reassume its initial rest position.

The blister contact member 11 is maintained on the printed circuit board 52 both by the resilient membrane covering, as already explained, the concave portion of the contact member, and by the head 92 of the plunger 9. The head 92 exerts a maintaining pressure on the blister contact member through the medium of the precompressed spring 10. The pressure exerted by the spring on the blister contact member varies according to the dimensions of the push-buttons used. This way of maintaining the blister contact member is interesting as it prevents it from being displaced by any undesired vibration.

Furthermore, the blister contact member 11 is removably mounted between the upper sub-assembly and the lower sub-assembly.

According to the invention, access to the push-button 4 and to the contact member 11 is obtained as follows.

In order to reach the push-button 4, the screws A are first unscrewed to release the panel device 1 from the wall 2. The screws B are thereafter unscrewed to dismount the assembly of plates 5 from the front face plate 3, thus allowing the access to the desired push-button through the cavity opening at the lower portion of the front face plate. Since the push-button body 41, the plunger 9 and the spring 10 together constitute a captured assembly, the access to the push-button is obtained without any separation of its associated elements.

In order to reach the blister contact member, the foregoing two unscrewing operations are repeated if necessary and then the screws C are unscrewed to detach the lower and upper sub-assemblies from one another. At the same time, the resilient membrane may be changed if defective by replacing the upper sub-assembly with a sub-assembly in good condition.

In the second form of embodiment illustrated in FIG. 2, there are only represented the references of the new members of the panel device, the identical portions of this device and of the one illustrated in the first form of embodiment being denoted by the same references.

In this form of embodiment, the depressable key 4' is an impulse and adjusting rotary push-button. Such a push-button allows making an electric contact on the printed circuit board and/or varying an electrical magnitude or value by actuating a rotary control member, for example, a potentiometer, contacter, or the like.

In this form of embodiment, the plunger 9' is a hollow body in which is located a sliding assembly driving in rotation a drive pin 12 for actuating the control member 13. The body of the control member 13 is rigidly mounted on the wall 2.

The upper portion of the push-button 4' comprises an elongated body 41' whose outer surface may be covered with an opaque material. The layer of opaque material may extend substantially down to the lower half of the body 41', whose upper half may be translucent so as to render the push-button luminous, or on the whole length of the body 41'.

The lower portion of the push-button body is cylindrical in cross section and of a diameter slightly smaller than the inner diameter of the cylindrical cavity provided in the front face plate 3. On the circular flat connecting surface between the lower portion of the push-button body and the upper, elongated body portion, is provided a projecting portion 42' bearing on the internal face of the flange portion 31 when the push-button is in the rest position. The contact surface between the flange portion 31 and the lower portion of the body 41' is thus limited in order to reduce friction during the rotation of the push-button.

The drive pin 12 of the member 13, when the latter is secured to the plate 2, passes through an orifice provided in the plate 51, an orifice of the printed circuit plate 52, traverses the blister contact member 11' provided with an orifice 11'*c* at the centre of its concave portion. Apart from the orifice in the contact member 11', the latter is identical in structure with the contact member 11 used in the first form of embodiment. The drive pin 12 is introduced in the cylindrical and longitudinal hollow portion of the body of piston 9'.

In the example illustrated, the connection between the drive pin 12 and the hollow body of the plunger 9' is by keying means, but any other type of connection may be used. The sliding keyed connection thus used consists of a longitudinal keying spline 9'*a* integral with the body 9' and introduced in a longitudinal slot 12*a* provided along the drive pin 12.

Thus the plunger 9' is axially slidable along the drive pin 12 and drives the latter in rotation through the sliding keyed connection.

When the push-button 4' is depressed, the body 41' of the push-button slides along the plunger 9', bears upon the internal upper portion of the elongated body of the plunger 9' through the medium of a cylindrical bearing surface 43'. The assembly constituted by the body 41' and the plunger 9' then slides along the drive pin 12 and the plunger head exerts a pressure on the concave surface of the blister contact member 11'. The latter is thus deformed as shown in the left portion of FIG. 2 and makes an electric contact on the printed circuit board. While maintaining this contact, it is possible to actuate the control member by simply rotating the push-button which then drives in rotation the drive pin 12 through the medium of the keyed connection.

After the necessary adjustments are completed, the pressure on the push-button 4' is released and the latter reassumes its rest position in the same manner as the push-button of the first form of embodiment.

In order to obtain access to the push-button 4' in case the latter is defective, it is sufficient to unscrew the screws A to detach the panel device 1 from the wall 2, and to raise the panel device in order to disassemble the sliding keyed connection. This operation is carried out without any separation of members associated with the push-button.

With each of the push-buttons shown in both forms of embodiment there may be associated a signal lamp which lights when each push-button is depressed. The lamp 14 is mounted on the printed circuit as is the bulb 6 and is directly accessible in the same manner as the latter. The head of the lamp 14 may be located in a longitudinal orifice provided in the front face plate 3. The internal periphery of this orifice may be covered with an opaque material preventing any outward diffusion of the light. A translucent cap 15 is inserted in the orifice opening on the outer face of the front face plate.

According to the invention, the panel device 1 is directly closed by the wall 2 of the apparatus and may be sealingly mounted on this wall.

Figure 6:
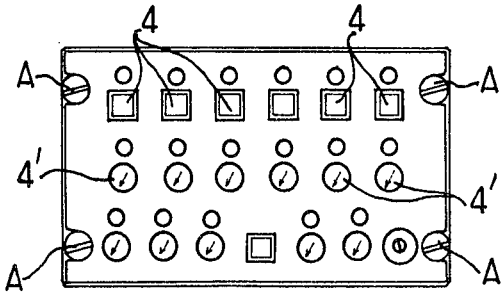
FIG. 6 is a top view of the front face of the panel device and represents various push-buttons according to the invention.

In FIG. 6 is shown the outer surface of the front face plate on which are mounted the push-buttons 4 and 4' of the invention. The impulse push-buttons 4 may be used for example for selecting a predetermined tuning radio frequency, whereas the rotary impulse push-buttons 4' allow for example tuning to another, non-predetermined frequency.

Thus, the panel device according to the invention is relatively easy of access and may be repaired in situ by the user in case of failure due to a defective part. This allows the services of a repairer to be dispensed with, thus reducing waste of time and repair costs.

Of course the invention is by no means limited to the forms of embodiment described and illustrated which have been given by way of example only. In particular, it comprises all means constituting technical equivalents to the means described as well as their combinations should the latter be carried out according to its gist and used within the scope of protection claimed.

What is claimed is:

1. A keyboard switch assembly adapted to be removably mounted on a wall of a vehicle dashboard or of another apparatus, said assembly comprising: a front face plate; an assembly of plates removably mounted under the front face plate, said plate assembly including a printed circuit board having electric contact thereon; a plurality of resiliently deformable contact members, each having a concave portion connected to supporting length of said contact member on said circuit board; a plurality of depressable keys projecting through said front face plate, each depressable key including a body portion positioned in a recess in said front face plate and a plunger having an elongated portion axially slidable within a chamber of said body portion and a bulging-shaped head adjacent to said concave portion of said contact member, said head having a flat surface on which bears one end of a compression spring surrounding said plunger, the other end of said spring resting in a cavity in said body portion; each of said keys being depressable to deflect via said bulging-shaped head a respective contact member to establish an electrical contact between contacts on said circuit board; wherein said plate assembly comprises a lower sub-assembly and an upper sub-assembly removably assembled to each other, said lower sub-assembly including three plates jointly assembled to each other and constituted by said printed circuit board interposed between an insulating plate provided with an orifice for accommodating said contact member on said circuit board and a thickness plate adapted to be situated contiguous to the wall of said apparatus, said upper sub-assembly including a resilient membrane secured under a membrane-carrying plate having an aperture through which said contact member projects, said resilient membrane contacting and covering the concave portion of said contact member so as to removably maintain it in the orifice of said insulating plate.

2. Keyboard assembly according to claim 1, wherein the stroke of travel of said elongated plunger portion in said chamber is limited by at least one protuberance jointly movable with the plunger and adapted to act against a corresponding at least one protuberance jointly movable with said depressable key so as to prevent the separation of said plunger from said key body portion when said plate assembly is disconnected from said front face plate.

3. Keyboard assembly according to claim 2, wherein said slidable assembly between said body portion and said plunger is provided with at least one slot extending along the elongated portion of said plunger and into which engages said protuberance jointly movable with the body portion of said depressable key.

4. Keyboard assembly according to claim 1, wherein said plunger has a cylindrical hollow part into which extends a rotatable pin for actuating an electric control member mounted on said wall of the apparatus, said pin passing through said lower and upper sub-assemblies and an aperture provided in the center of said contact member, said pin being connected to said plunger for rotation therewith and via a slidable spline means so that rotation of said key drives said pin in rotation whereby an electric magnitude is changed when said bulging-shaped head deflects said contact member to establish an electric contact between contacts on said circuit board.

5. Keyboard assembly according to claim 4, wherein said slidable spline means includes a longitudinal spline jointly connected within the cylindrical hollow part of said plunger and engaging into a longitudinal slot of said actuating pin.

6. Keyboard switch assembly adapted to be removably mounted on a wall of a vehicle dashboard or of another apparatus, said assembly comprising: a front face plate; an assembly of plates removably mounted under the front face plate, said plate assembly including a printed circuit board having electrical contacts thereon; a plurality of resiliently deformable contact members, each having a concave portion connected to said contact member on said circuit board; a plurality of depressable keys projecting through said front face plate, each depressable key including a body portion positioned in a recess in said front face plate and a plunger having an elongated portion axially slidable within a chamber of said body portion and a bulging-shaped head adjacent to said concave portion of said contact members, said head having a flat surface on which bears one end of a compression spring surrounding said plunger, the other end of said spring resting in a cavity in said body portion; each of said keys being depressable to deflect via said bulging-shaped head a respective contact member to establish an electrical contact between the contacts on said circuit board; wherein said plate assembly comprises a lower sub-assembly and an upper sub-assembly removably assembled to each other, said lower sub-assembly including three plates jointly assembled on each other and constituted by said printed circuit board interposed between an insulating plate provided with an orifice for accommodating said contact member on said circuit board and a thickness plate adapted to be situated contiguous to the wall of said apparatus, said upper sub-assembly including a resilient membrane secured under a membrane-carrying plate having an aperture through which said contact member projects, said resilient membrane contacting and covering the concave portion of said contact member so as to removably maintain it in the orifice of said insulating plate; said plunger having a cylindrical hollow part into which extends a rotatable pin for actuating an electric control member mounted on said wall of the apparatus, said pin passing through said lower and upper sub-assemblies and an aperture provided in the center of said contact member, said pin being connected to said plunger for rotation therewith within said cylindrical hollow part via a slidable spline means so that rotation of said key drives said pin in rotation whereby an electric magnitude is changed when said bulging-shaped head deflects said contact member to establish an electric contact between contacts on said circuit board.

* * * * *